US006450068B1

(12) United States Patent
Hu

(10) Patent No.: US 6,450,068 B1
(45) Date of Patent: Sep. 17, 2002

(54) RATCHET TYPE RING SPANNER HAVING A LARGER CAVITY FOR RECEIVING A LARGER PAWL

(76) Inventor: Bobby Hu, 8F-1, No. 536~1, Ta Ching Street, Taichung (TW)

( * ) Notice: Subject to any disclaimer, the term of this patent is extended or adjusted under 35 U.S.C. 154(b) by 0 days.

(21) Appl. No.: 09/940,412

(22) Filed: Aug. 27, 2001

(30) Foreign Application Priority Data

Jul. 13, 2001 (TW) ..... 90212018 U

(51) Int. Cl.[7] ..... B25B 13/46
(52) U.S. Cl. ..... 81/63.2
(58) Field of Search ..... 81/62, 63, 63.1, 81/63.2; 192/43.1, 43.2

(56) References Cited

U.S. PATENT DOCUMENTS 4,807,500 A 2/1989 Main
5,495,783 A 3/1996 Slusar et al.
6,205,889 B1 3/2001 Hsieh
6,282,993 B1 9/2001 Forman et al.
2001/0035074 A1 11/2001 Hu
2002/0017169 A1 2/2002 Hu
2002/0023519 A1 2/2002 Hu
2002/0023520 A1 2/2002 Hu
2002/0026858 A1 3/2002 Hu

*Primary Examiner*—D. S. Meislin
(74) *Attorney, Agent, or Firm*—Alan Kamrath; Rider, Bennett, Egan & Arundel, LLP

(57) ABSTRACT

A ratchet type ring spanner comprises a handle having a larger cavity for receiving a larger pawl to thereby provide an improved torque-bearing capacity. The pawl is configured to be pressed against a wall defining the cavity of the handle in a manner that the torque is exerted on all of the teeth of the pawl in a more balanced manner to further improve the torque-bearing capacity.

5 Claims, 13 Drawing Sheets

A–A

RATCHET TYPE RING SPANNER HAVING A LARGER CAVITY FOR RECEIVING A LARGER PAWL

BACKGROUND OF THE INVENTION

1. Field of the Invention

The present invention relates to a ratchet type ring spanner having a larger cavity for receiving a larger pawl.

2. Description of the Related Art

Ring spanners can be used in a limited space, e.g., an engine room of a vehicle, as they have a small-size head when compared with other kinds of wrenches. Ratchet type ring spanners have been developed to overcome the problem of insufficient torque-bearing capacity, which largely depends on the size of the pawl. FIGS. 8A and 8B of the drawings illustrate formation of a conventional ratchet type ring spanner by means of placing a T-shaped milling cutter 6 in a hole 2 in the head 9 and then moving the T-shaped milling cutter 6 toward the handle 1, thereby forming a cavity 3 in a web between the head 9 and the handle 1. However, the size of the cavity 3 thus formed is limited, as the shaft 7 of the T-shaped cutter 6 is restrained by an inner periphery defining the hole 2 of the head 9. Namely, the cavity 3 is relatively shallow and thus only capable of receiving a pawl 4 having a relatively small thickness. As a result, the pawl 4 that engages with a drive wheel 5 (FIG. 9) rotatably received in the hole 2 of the head 9 for driving fasteners cannot provide a high torque-bearing capacity.

In addition, as illustrated in FIG. 9, the pawl 4 is pressed against a wall defining the cavity 3 at a point 8 that is relatively away from a center of the wall defining the cavity 3. Typically, the pressing point 8 approximately corresponds to the position of the third tooth of the pawl 4 counting from an adjacent end of the pawl 4. There is no support for the inner lateral side of the pawl 4 facing away from the gear wheel 5. Thus, no reactive force is obtained when the pawl 4 is subjected to a force greater than a critical value. The other lateral side of the pawl 4 facing the gear wheel 5 pivots about the pressing point 8 and slightly disengages from the teeth of the gear wheel 4. As a result, a seesaw effect is incurred on the pawl 4 which leads to a poor engagement between the pawl 4 and the gear wheel 5; namely, the pawl 4 merely engages with the gear wheel 5 by the first three teeth, which tends to cause damage to these three teeth. A solution to increase the torque-bearing capacity is to increase the size of the pawl 4, yet this contradicts the advantage of ring spanners for use in limited spaces, as the size of the head 9 is also increased.

SUMMARY OF THE INVENTION

An object of the present invention is to provide a ratchet type ring spanner having a larger cavity for receiving a larger pawl.

A ratchet type ring spanner comprises a handle having a larger cavity for receiving a larger pawl to thereby provide an improved torque-bearing capacity. The pawl is configured to be pressed against a wall defining the cavity of the handle in a manner that the torque is exerted on all of the teeth of the pawl in a more balanced manner to further improve the torque-bearing capacity.

In accordance with a preferred embodiment of the invention, a ratchet type ring spanner comprises:

a handle having a cavity, the handle further comprising two lateral sides, a transverse hole being defined in each said lateral side and communicated with the cavity, a first switch rod and a second switch rod being respectively, slidably mounted in the transverse holes, each of the first switch rod and the second switch rod having an outer end and an inner end, the first switch rod and the second switch rod being movable between a first position corresponding to a first ratcheting direction of the ratchet type ring spanner and a second position corresponding to a second ratcheting direction opposite to the first ratcheting direction;

a head extending from the handle and comprising a hole communicated with the cavity of the handle;

a drive member rotatably mounted in the hole of the head, the drive member comprising a plurality of teeth on an outer periphery thereof;

a pawl slidably mounted in the cavity of the handle, the pawl comprising a first lateral side facing the drive member and a second lateral side facing away from the drive member, the first lateral side of the pawl having a plurality of teeth for meshing with the plurality of teeth of the drive member, the second lateral side of the pawl comprising a first positioning section and a second positioning section, the pawl further comprising a first end adjacent to the first positioning section and a first arcuate face between the first end and the first positioning section, the pawl further comprising a second end adjacent to the second positioning section and a second arcuate face between the second end and the second positioning section; and means for selectively engaging with one of the first positioning section and the second positioning section of the pawl to bias the pawl to engage with the plurality of teeth of the drive member corresponding to the position of the first switch rod and the second switch rod;

wherein when the first switch rod and the second switch rod are in the first position, the first end of the pawl is pressed against the inner end of the first switch rod, the second end of the pawl is pressed against and in face-to-face contact with the inner end of the second switch rod, and the second arcuate face of the pawl is pressed against and in face-to-face contact with a wall defining the cavity of the handle; and wherein when the first switch rod and the second switch rod are in the second position, the second end of the pawl is pressed against the inner end of the second switch rod, the first end of the pawl is pressed against and in face-to-face contact with the inner end of the first switch rod, and the first arcuate face of the pawl is pressed against and in face-to-face contact with the wall defining the cavity of the handle.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
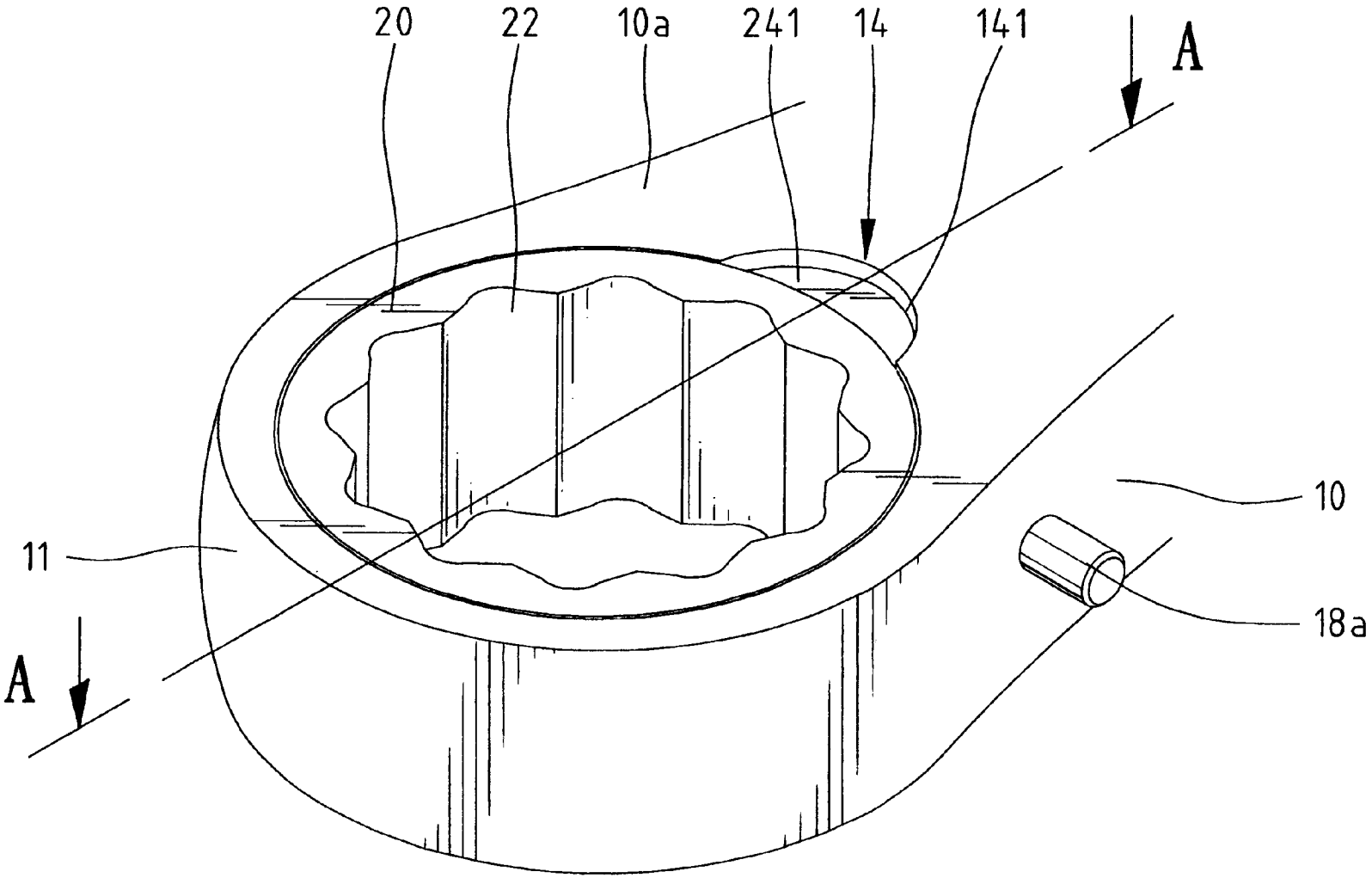
FIG. 1A is a bottom perspective view of a portion of a ratchet type ring spanner in accordance with the present invention.
Figure 1B:
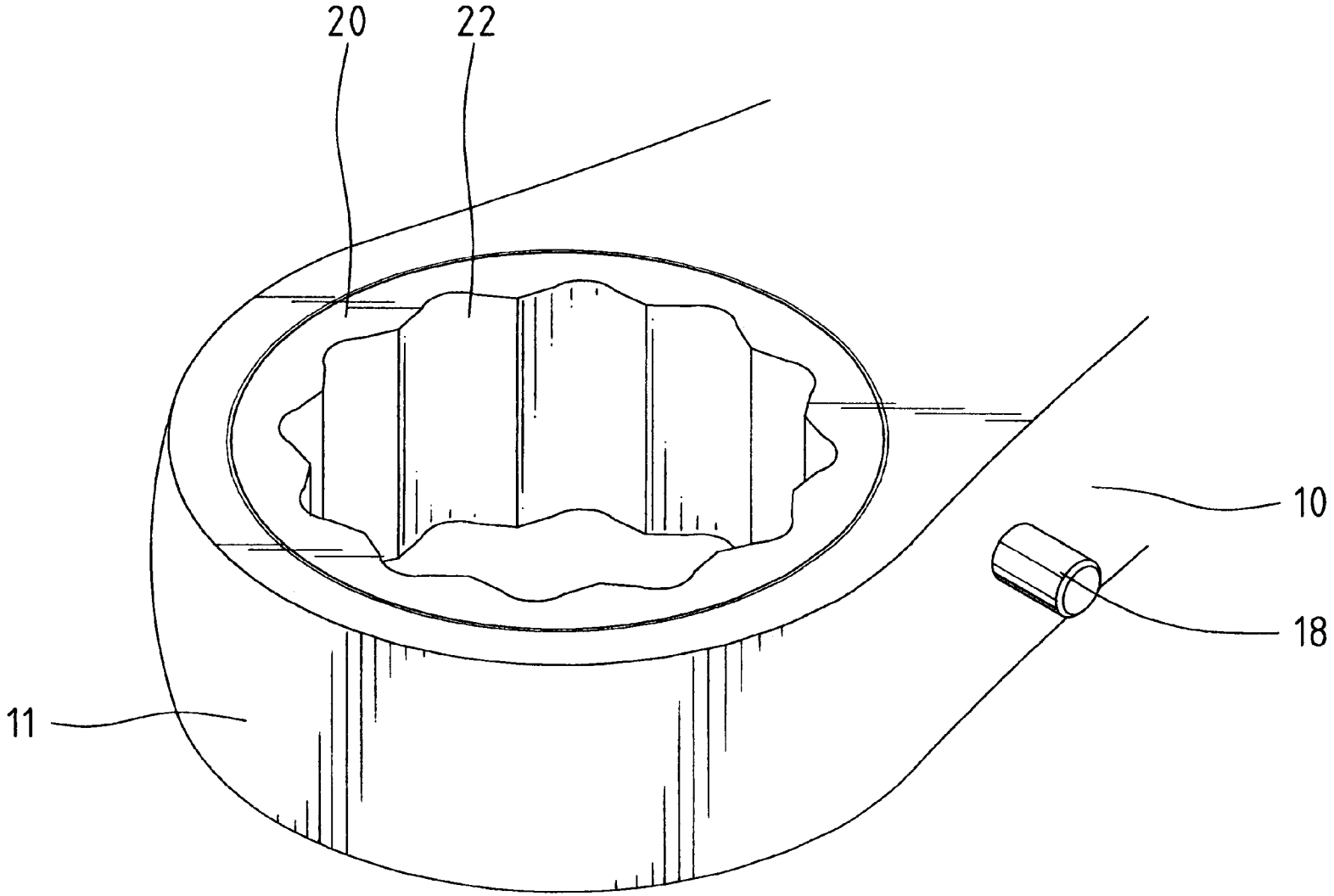
FIG. 1B is a top perspective view of the portion of the ratchet type ring spanner in accordance with the present invention.
Figure 2:
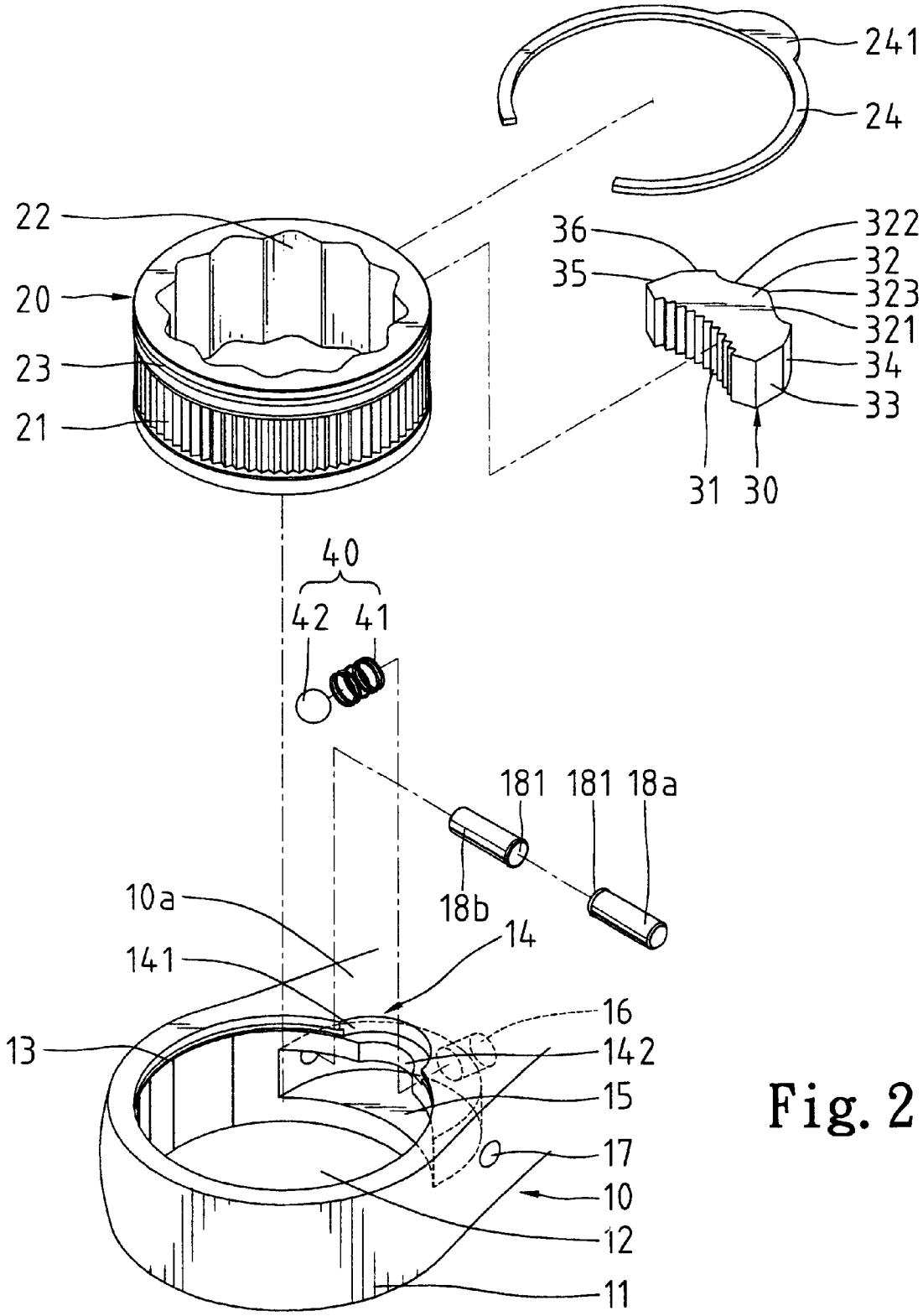
FIG. 2 is a bottom exploded perspective view of the portion of the ratchet type ring spanner in accordance with the present invention.

Referring to FIGS. 1A, 1B, and 2, a ratchet type ring spanner in accordance with the present invention generally comprises a handle 10 and a head 11 extending from the handle 10. The head 11 comprises a hole 12 for rotatably receiving a drive member 20. An annular groove 13 is defined in an inner periphery defining the hole 12 of the head 11. A C-clip 24 is received in the annular groove 13 and an annular groove 23 defined in an end of an outer periphery of the drive member 20, thereby rotatably mounting the drive member 20 in the hole 12 of the head 11. In this embodiment, the drive member 20 is in the form of a gear wheel having a plurality of teeth 21 in an outer periphery thereof. The gear wheel 20 further comprises an inner polygonal periphery 22 for engaging with and thus driving a fastener, such as a nut or bolt head.

Figure 5:
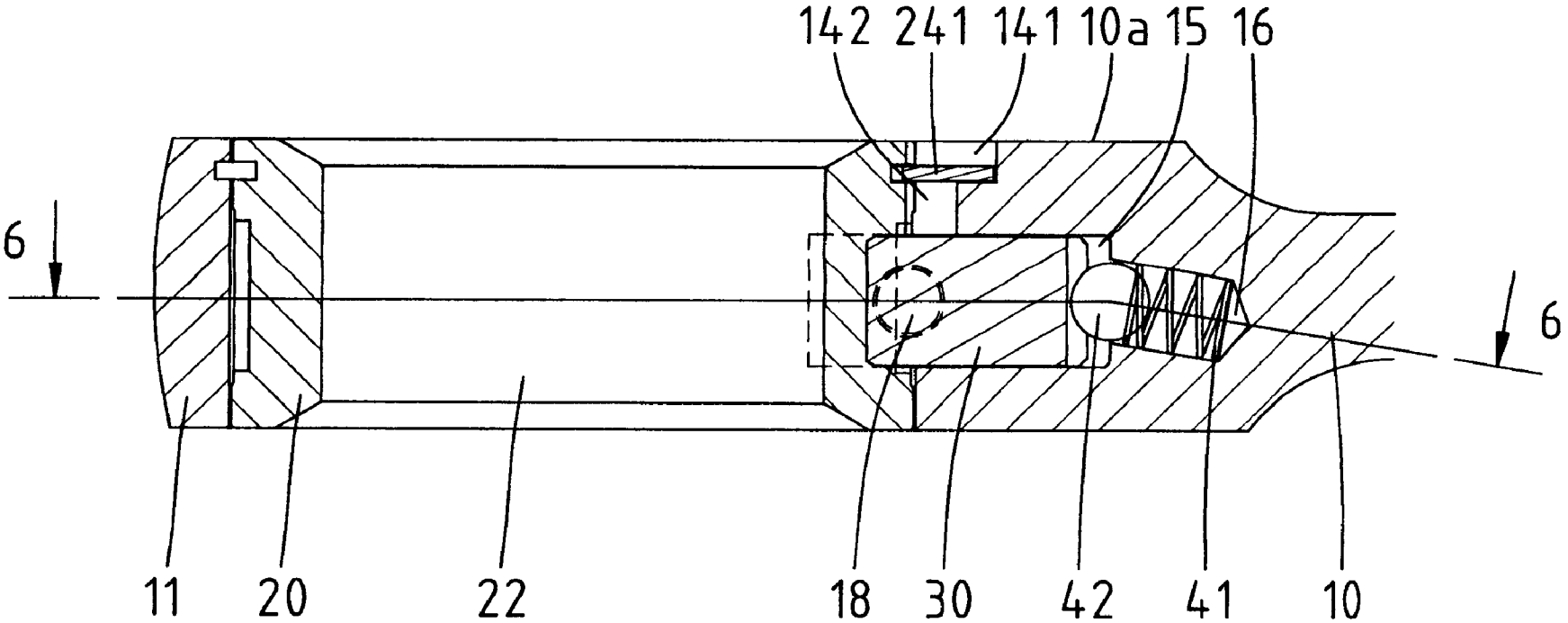
FIG. 5 is a sectional view, taken along line A—A in FIG. 1, of the portion of the ratchet type ring spanner in accordance with the present invention before formation.
Figure 6:
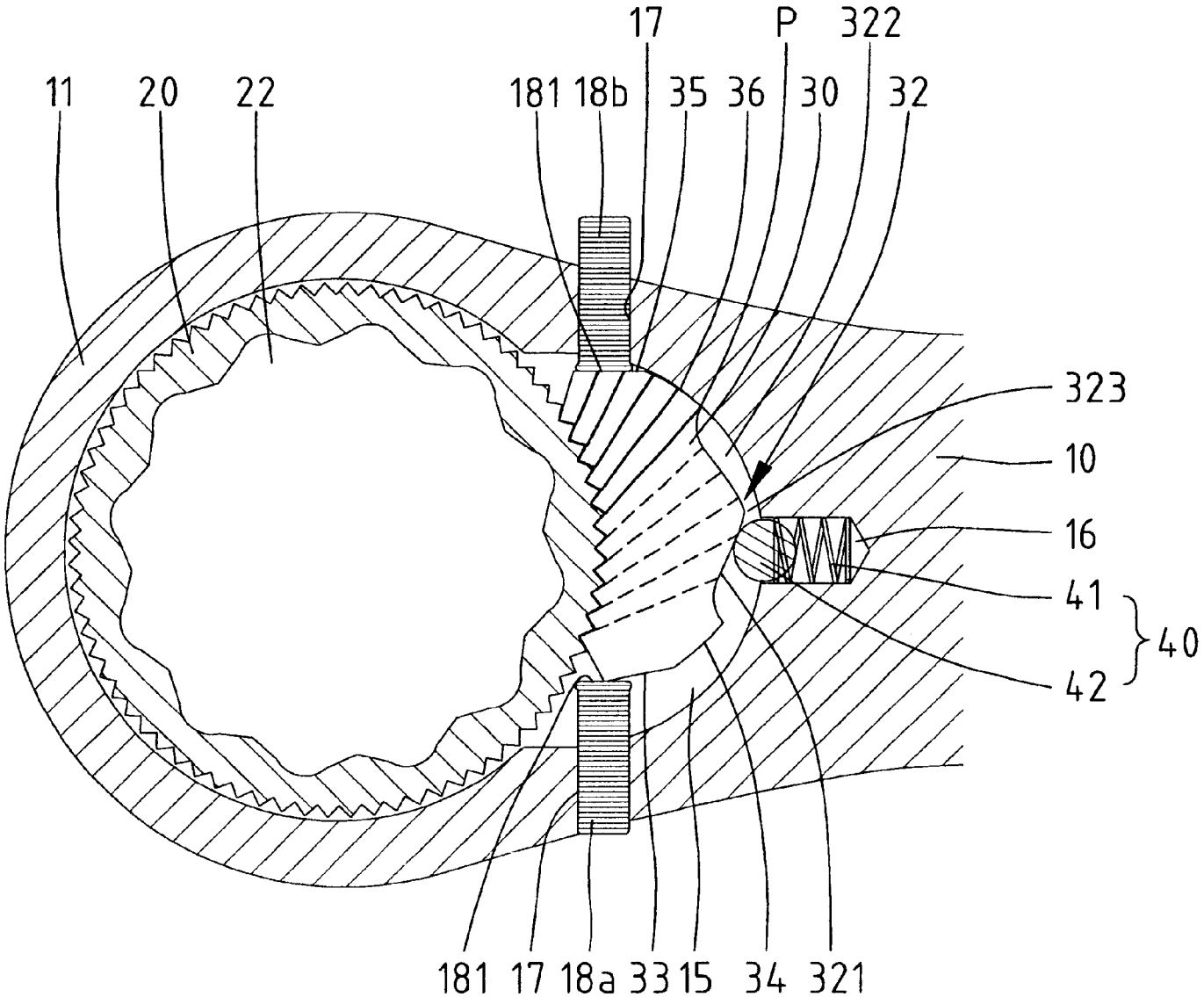
FIG. 6 is a sectional view taken along line 6—6 in FIG. 5.

Still referring to FIG. 2 and further to FIGS. 5 and 6, a receptacle 16 is defined in a wall defining a portion of the cavity 15 of the handle 10 for receiving a biasing means 40. In this embodiment, the biasing means 40 comprises a ball 42 and an elastic element 41. A pawl 30 is slidably received in the cavity 15 of the handle 10 and comprises a first lateral side facing the gear wheel 20 and a second lateral side facing away from the gear wheel 20. Plural teeth 31 are defined in the first lateral side of the pawl 30. A substantially V-shaped positioning portion 32 is formed on the second lateral side of the pawl 30 and comprises a first positioning section 321, a second positioning section 322, and a transition section 323 between the first positioning section 321 and the second positioning section 322. Preferably, each positioning section 321, 322 is concave for retaining the ball 42 in place. In addition, the pawl 30 comprises a first end 33 adjacent to the first positioning section 321 and a first arcuate face 34 between the first end 33 and the first positioning section 321. Further, the pawl 30 comprises a second end 35 adjacent to the second positioning section 322 and a second arcuate face 36 between the second end 35 and the second positioning section 322.

The handle 10 further comprises a transverse hole 17 in each of two lateral sides thereof. Each transverse hole 17 is communicated with the cavity 15 of the handle 10, and a switch rod 18*a*, 18*b* is received in a respective transverse hole 17. At least one of the switch rods 18*a* and 18*b* has an outer end exposed outside the handle 10 for manual operation.

Figure 3A:
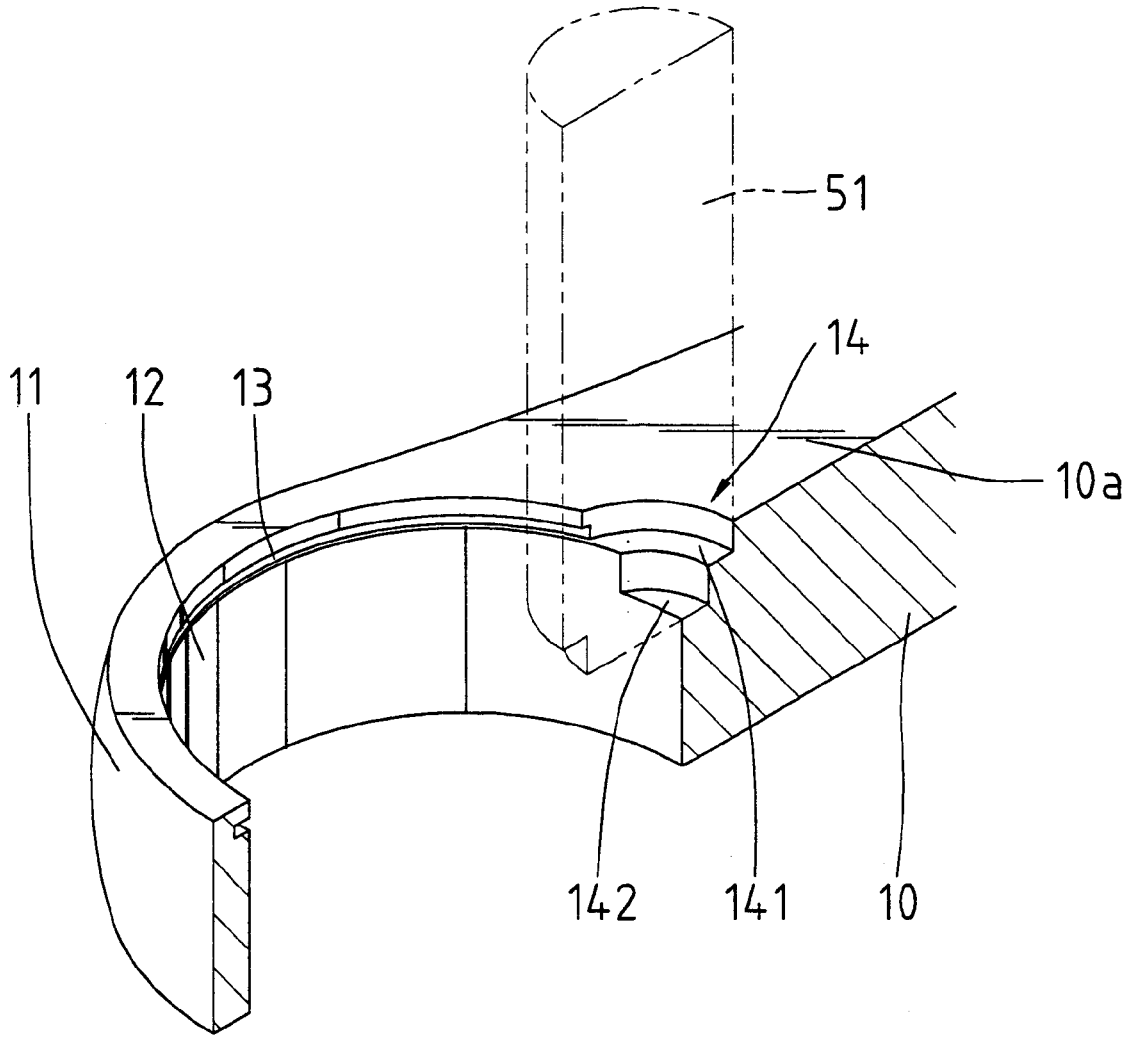
FIG. 3A is a schematic perspective view, partly cutaway, illustrating formation of a cutout in a face of the handle of the ratchet type ring spanner in accordance with the present invention.
Figure 3B:
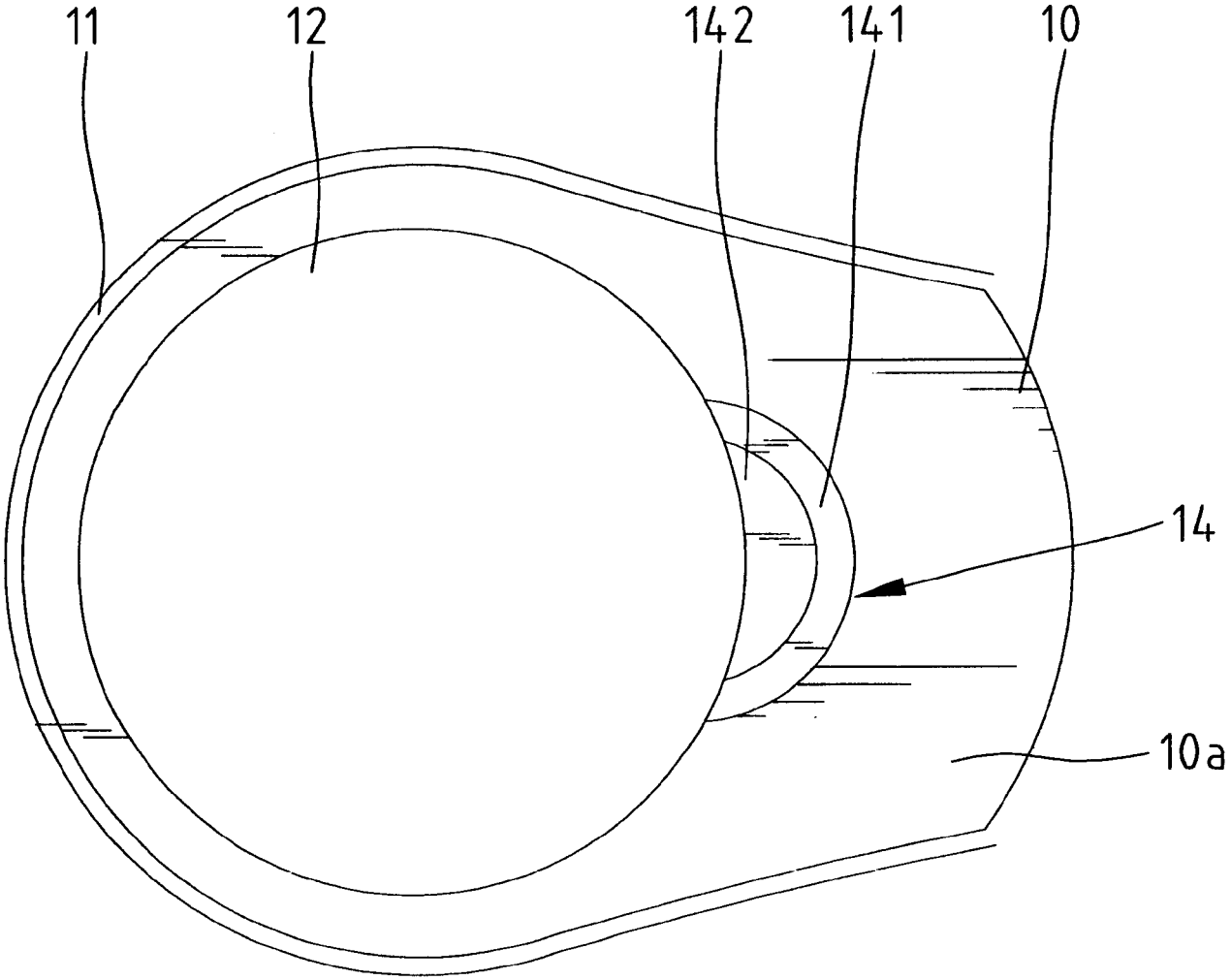
FIG. 3B is a bottom view of the portion of the ratchet type ring spanner in FIG. 3A.
Figure 4A:
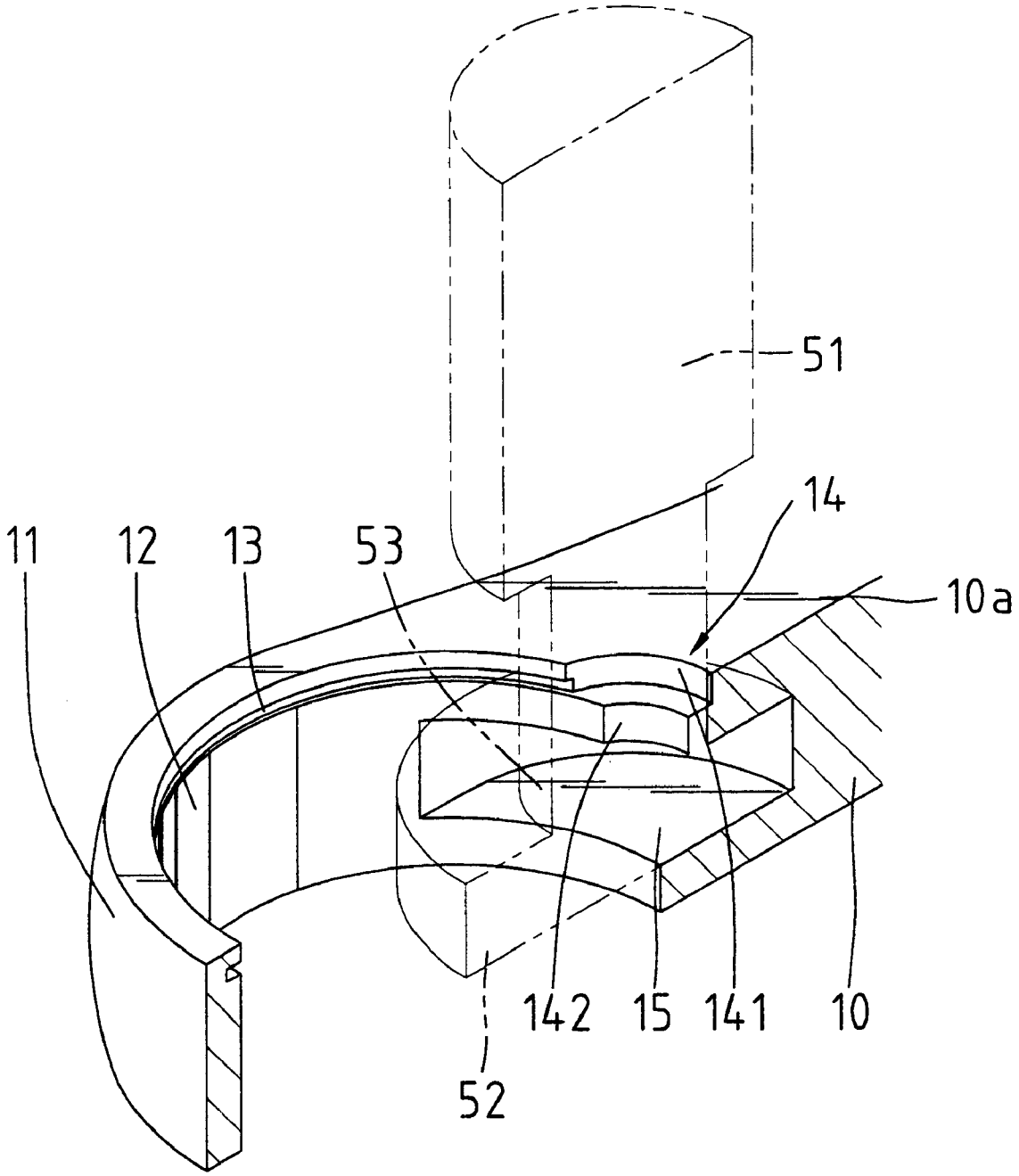
FIG. 4A is a view similar to FIG. 3A, wherein a cavity is formed in a handle of the ratchet type ring spanner.
Figure 4B:
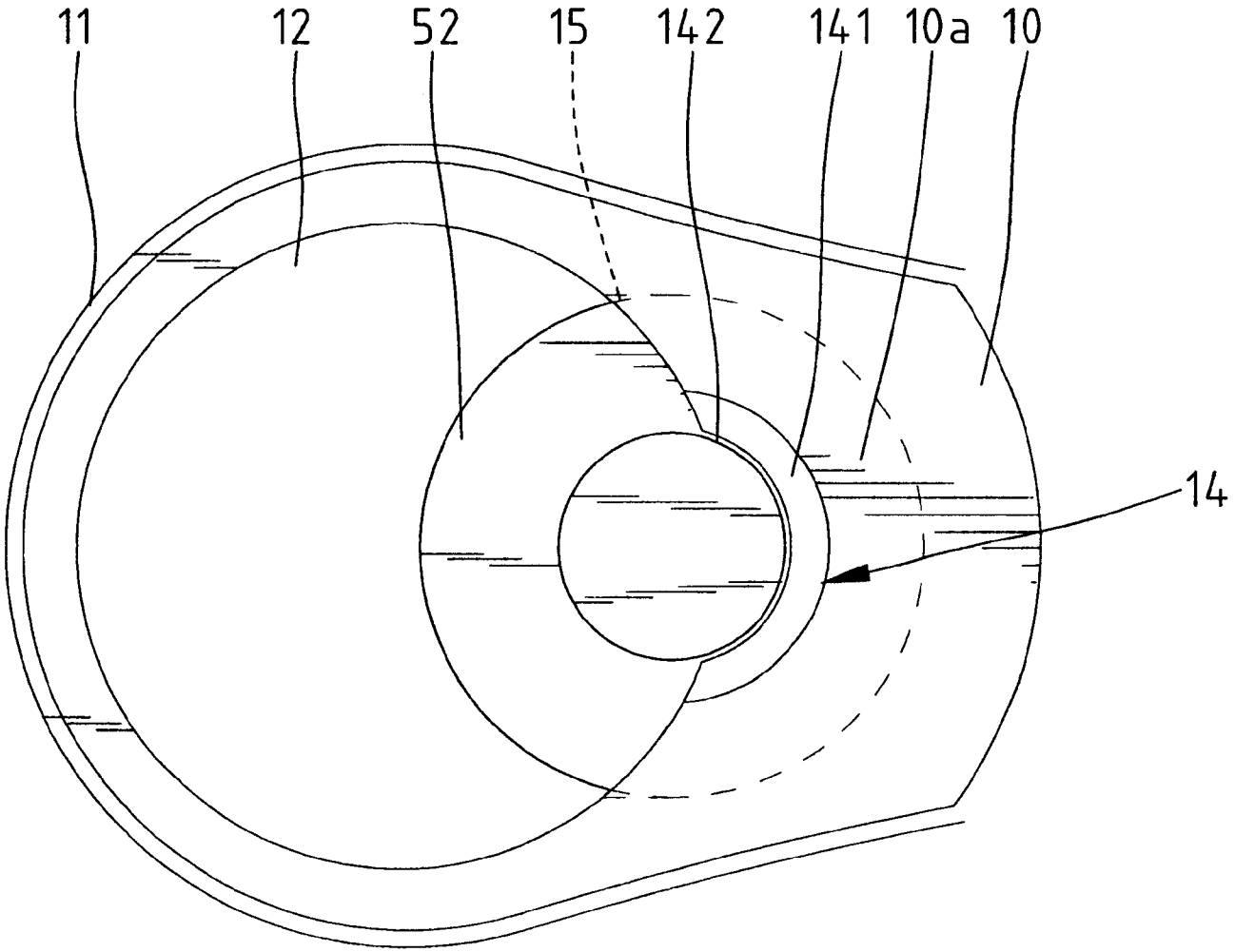
FIG. 4B is a view similar to FIG. 3B, wherein a cavity is formed in a handle of the ratchet type ring spanner.

It is noted that the pawl 30 has a relatively larger thickness (i.e., the distance between the first lateral side and the second lateral side of the pawl 30) when compared with that of the conventional pawl. This thanks to the relatively larger size of the cavity 15 of the handle 10. In order to form a cavity 15 of a larger size in the handle 10, a sector-like stepped portion or cutout 14 is firstly formed in a face 10*a* of the handle 10 and communicated with the hole 12 of the head 11, best shown in FIGS. 3A and 3B. The stepped portion or cutout 14 comprises a stair 141 and a recessed portion 142 inward of the stair 141. In an alternative embodiment, the stair 141 may be omitted. The stepped portion or cutout 14 can be formed by a milling cutter 51 or other suitable means. Next, a T-shaped milling cutter 52 is placed into the hole 12 of the head 11 and moved toward the handle 10 until a shaft 53 of the T-shaped milling cutter 52 is stopped by the recessed portion 142 or the stair 141 of the stepped portion or cutout 14. Provision of the stepped portion or cutout 14 allows the T-shaped milling cutter 52 to move deeper into the handle 10, thereby forming a larger cavity 15 when compared with that formed by conventional methods, best shown in FIGS. 4A and 4B. The C-clip 24 may comprise an extension 241 for covering the stepped portion or cutout 14. Alternatively, a plug or insert can be mounted into the stepped portion or cutout 14 for covering the recessed portion 142.

When the ratchet type ring spanner is in a state shown in FIGS. 5 and 6, the ball 42 is biased by the elastic element 41 to engage with the first positioning section 321. The first end 33 of the pawl 30 is pressed against an inner end 181 of the associated switch rod 18*a*, the second end 35 of the pawl 30 is pressed against the inner end 181 of the associated switch rod 18*b*, and the second arcuate face 36 of the pawl 30 is pressed against the wall defining the portion of the cavity 15 of the handle 10. The second end 35 of the pawl 30 is in face-to-face contact with the inner end 181 of the associated switch rod 18*b*, and the second arcuate face 36 of the pawl 30 is in face-to-face contact with the wall defining the cavity 15 of the handle 10. Thus, the critical supporting point P of the pawl 30 relative to the wall defining the cavity 15 of the handle 10 is located in a position approximately corresponding to the fifth tooth counting from the second end 35 of the pawl 30 such that the number of teeth on a left side of the critical supporting point P is approximately equal to that of teeth on a right side of the critical supporting point P. Thus, the force imparted to the teeth on the right side of the critical supporting point P is approximately equal to that imparted to the teeth on the left side of the critical supporting point P. Namely, the torque is exerted on all of the teeth 31 of the pawl 30 in a more balanced manner to thereby largely improve the torque-bearing capacity of the pawl 30. In addition, the thickness of the pawl 30 can be increased due to the larger cavity 15 of the handle 10, which also contributes the increase in the torque-bearing capacity. Damage to the teeth 31 of the pawl 30 resulting from uneven force distribution is prevented.

Figure 7:
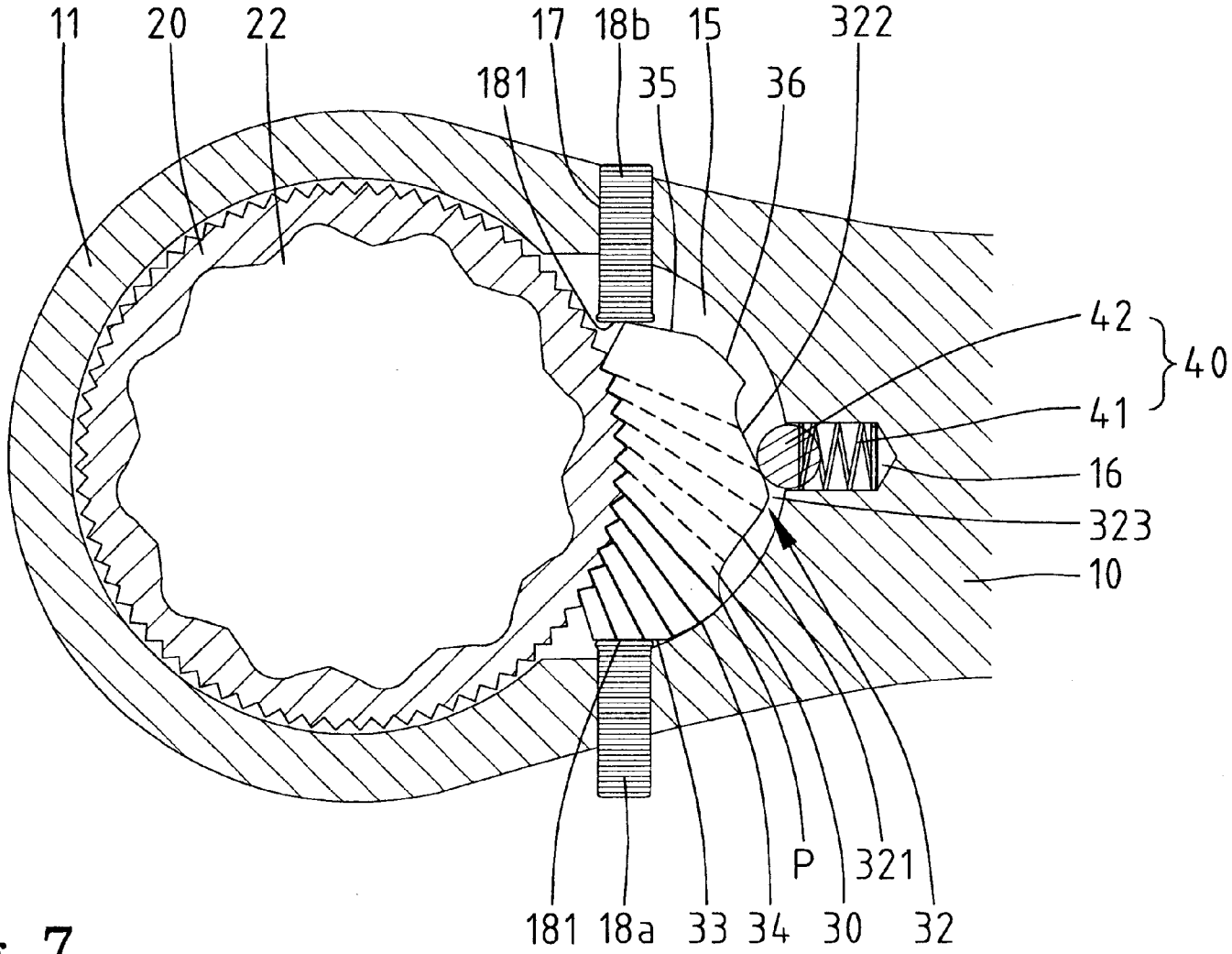
FIG. 7 is a sectional view similar to FIG. 6, wherein the ring spanner is in a state for ratcheting in a reverse direction.
Figure 8A:
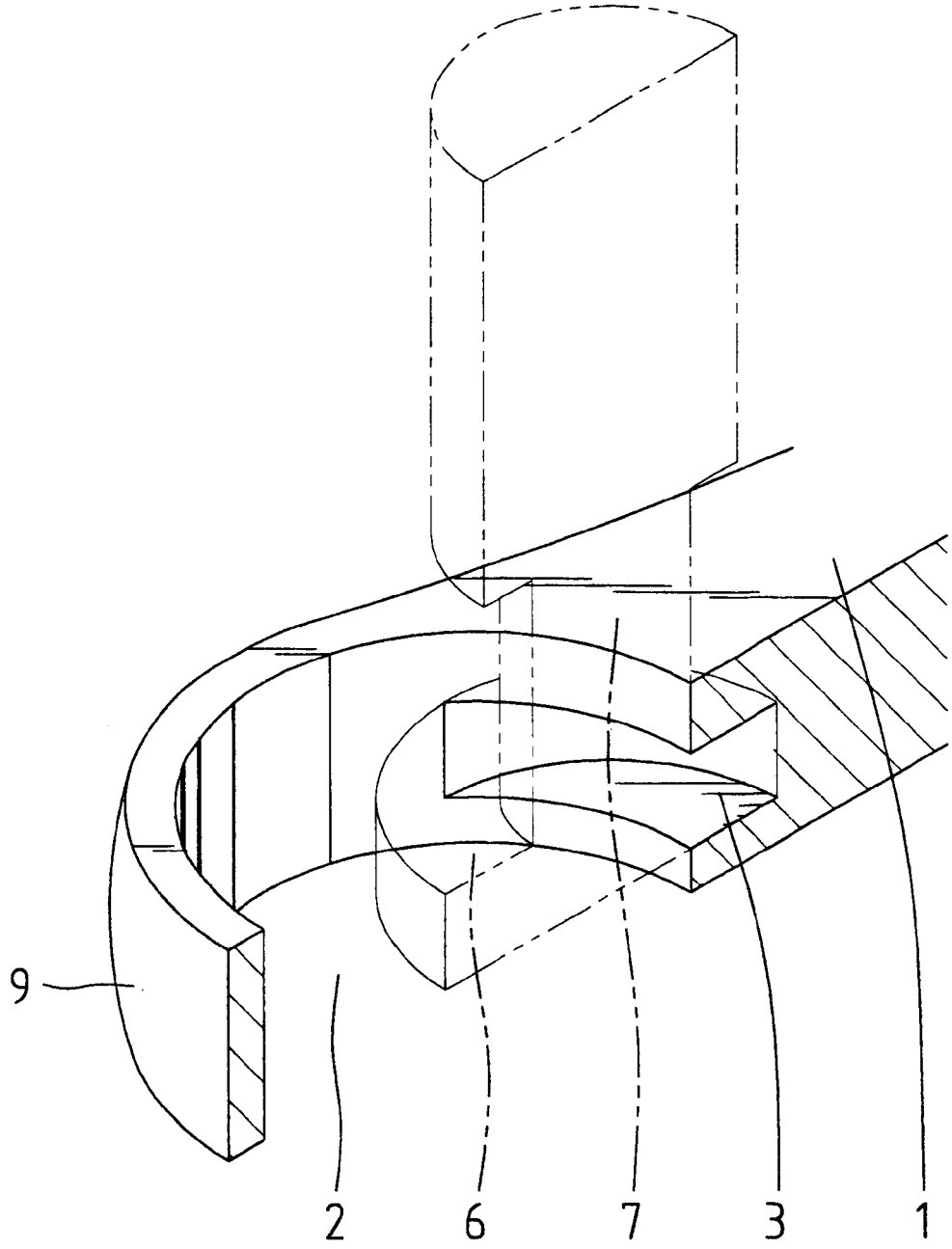
Fig. 8A PRIOR ART
FIG. 8A is a schematic perspective view illustrating formation of a conventional ratchet type ring spanner.
Figure 8B:
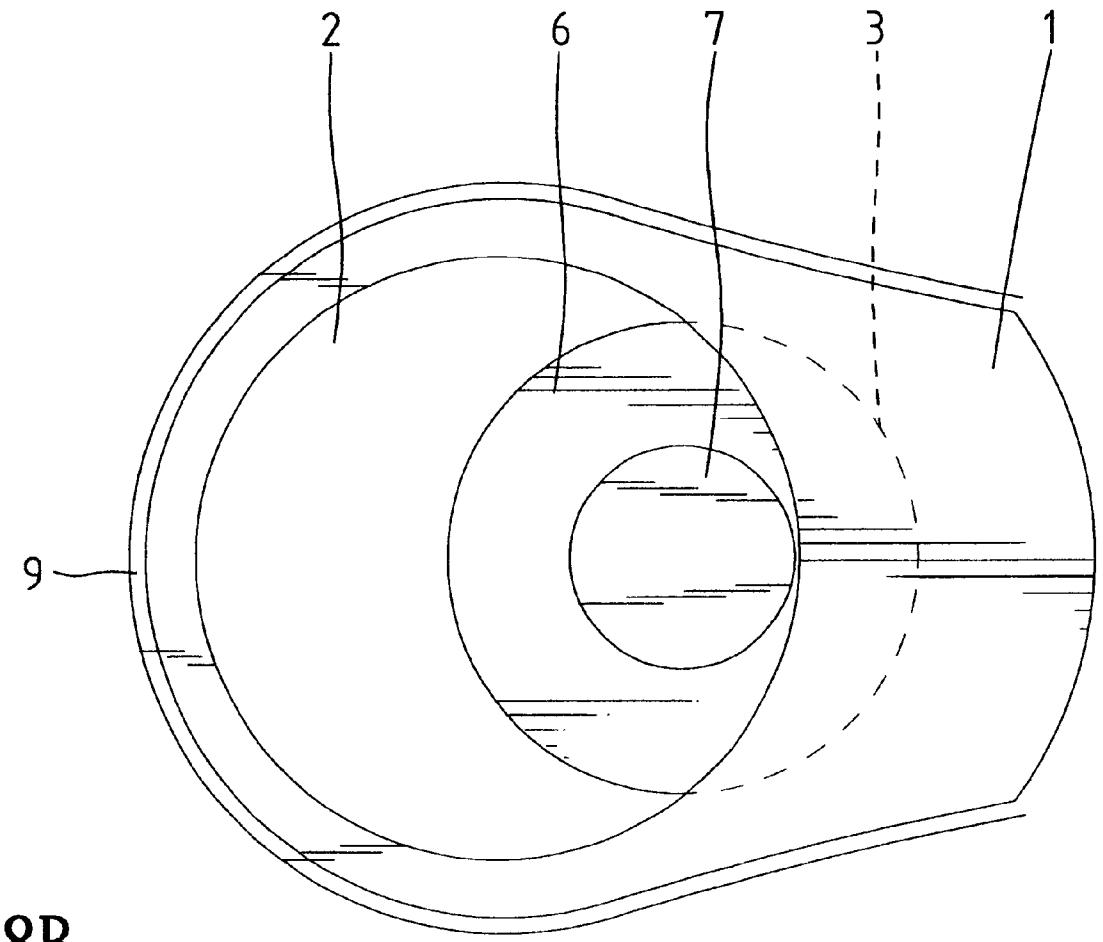
Fig. 8B PRIOR ART
FIG. 8B is a schematic top view illustrating formation of the conventional ratchet type ring spanner.
Figure 9:
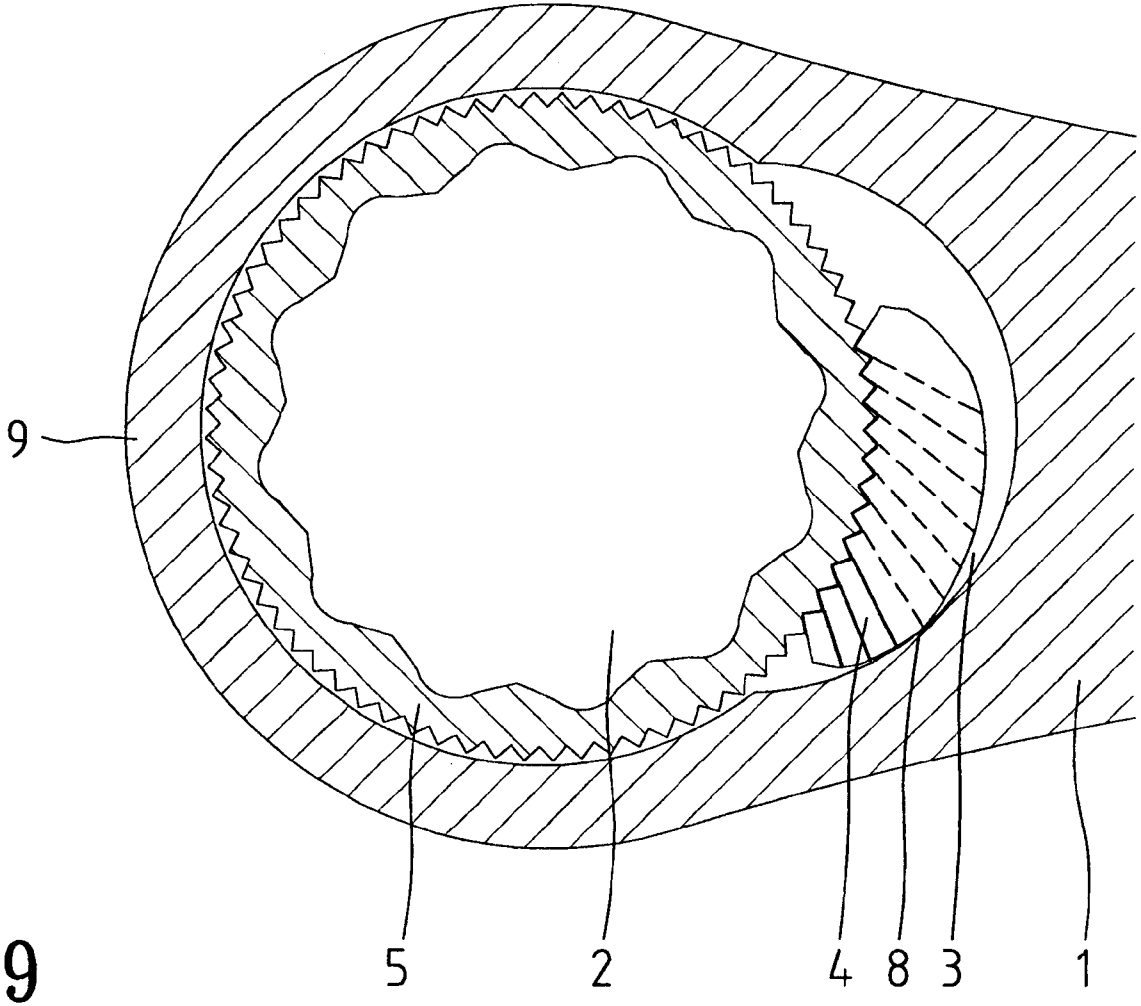
Fig. 9 PRIOR ART
FIG. 9 is a schematic sectional view of the conventional ratchet type ring spanner.

When the operator pushes the switch rods 18*a* and 18*b* downward (see the direction of the ring spanner in FIG. 6) by means of operating the outer ends of the switch rods 18*a* and 18*b* that are exposed outside the handle 10, the ratchet type ring spanner is shifted to a state shown in FIG. 7, in which the ball 42 is moved across the transition section 323 of the pawl 30 into the second positioning section 322. The second end 35 of the pawl 30 is pressed against the inner end 181 of the associated switch rod 18*b*, the first end 33 of the pawl 30 is pressed against the inner end 181 of the associated switch rod 18*a*, and the first arcuate face 34 of the pawl

30 is pressed against the wall defining the portion of the cavity 15 of the handle 10. The first end 33 of the pawl 30 is in face-to-face contact with the inner end 181 of the associated switch rod 18*a,* and the first arcuate face 34 of the pawl 30 is in face-to-face contact with the wall defining the cavity 15 of the handle 10. Again, the critical supporting point P of the pawl 30 relative to the wall defining the cavity 15 of the handle 10 is located in a position approximately corresponding to the fifth tooth counting from the first end 33 of the pawl 30 such that the number of teeth on a left side of the critical supporting point P is approximately equal to that of teeth on a right side of the critical supporting point P. Thus, the force imparted to the teeth on the right side of the critical supporting point P is approximately equal to that imparted to the teeth on the left side of the critical supporting point P. Namely, the torque is exerted on all of the teeth 31 of the pawl 30 in a more balanced manner to thereby largely improve the torque-bearing capacity of the pawl 30.

According to the above description, it is appreciated that the present invention provides a larger cavity 15 in the handle 10 for receiving a larger pawl 30 to thereby improve the torque-bearing capacity. In addition, the arrangement of the two switch rods 18*a* and 18*b* and the pawl 30 allows an improved force distribution to further improve the overall torque-bearing capacity of the pawl 30. Also, the present invention provides a novel method for forming a larger cavity 15 in the handle 10.

Although the invention has been explained in relation to its preferred embodiment, it is to be understood that many other possible modifications and variations can be made without departing from the scope of the invention as hereinafter claimed.

What is claimed is:

1. A ratchet type ring spanner comprising:

a handle having a cavity, the handle further comprising two lateral sides, a transverse hole being defined in each said lateral side and communicated with the cavity, a first switch rod and a second switch rod being respectively, slidably mounted in the transverse holes, each of the first switch rod and the second switch rod having an outer end and an inner end, the first switch rod and the second switch rod being movable between a first position corresponding to a first ratcheting direction of the ratchet type ring spanner and a second position corresponding to a second ratcheting direction opposite to the first ratcheting direction;

a head extending from the handle and comprising a hole communicated with the cavity of the handle;

a drive member rotatably mounted in the hole of the head, the drive member comprising a plurality of teeth on an outer periphery thereof;

a pawl slidably mounted in the cavity of the handle, the pawl comprising a first lateral side facing the drive member and a second lateral side facing away from the drive member, the first lateral side of the pawl having a plurality of teeth for meshing with the plurality of teeth of the drive member, the second lateral side of the pawl comprising a first positioning section and a second positioning section, the pawl further comprising a first end adjacent to the first positioning section and a first arcuate face between the first end and the first positioning section, the pawl further comprising a second end adjacent to the second positioning section and a second arcuate face between the second end and the second positioning section; and means for selectively engaging with one of the first positioning section and the second positioning section of the pawl to bias the pawl to engage with the plurality of teeth of the drive member corresponding to the position of the first switch rod and the second switch rod;

wherein when the first switch rod and the second switch rod are in the first position, the first end of the pawl is pressed against the inner end of the first switch rod, the second end of the pawl is pressed against and in face-to-face contact with the inner end of the second switch rod, and the second arcuate face of the pawl is pressed against and in face-to-face contact with a wall defining the cavity of the handle; and wherein when the first switch rod and the second switch rod are in the second position, the second end of the pawl is pressed against the inner end of the second switch rod, the first end of the pawl is pressed against and in face-to-face contact with the inner end of the first switch rod, and the first arcuate face of the pawl is pressed against and in face-to-face contact with the wall defining the cavity of the handle.

2. The ratchet type ring spanner as claimed in claim 1, wherein the wall defining the cavity comprises a receptacle defined therein, the biasing means comprises an elastic element received in the receptacle and a ball biased by the elastic element to selectively engage with one of the first positioning section and the second positioning section of the pawl.

3. The ratchet type ring spanner as claimed in claim 2, wherein each of the first positioning section and the second positioning section of the pawl is concave.

4. The ratchet type ring spanner as claimed in claim 3, further comprising a transition section between the first positioning section and the second positioning section.

5. The ratchet type ring spanner as claimed in claim 1, wherein at least one of the outer ends of the first switch rod and the second switch rod is exposed outside the handle for manual operation.

* * * * *